US006394845B1

(12) United States Patent
Lin

(10) Patent No.: US 6,394,845 B1
(45) Date of Patent: May 28, 2002

(54) FIXED DEVICE FOR THE BULB SOCKET

(76) Inventor: Chi Hua Lin, No. 304, Sing-Sun Rd., Chu-Dong, Hsin-chu (TW), 310

( * ) Notice: Subject to any disclaimer, the term of this patent is extended or adjusted under 35 U.S.C. 154(b) by 0 days.

(21) Appl. No.: 09/677,761

(22) Filed: Oct. 3, 2000

(51) Int. Cl.[7] ..... H01K 1/00
(52) U.S. Cl. ..... 439/619
(58) Field of Search ..... 439/619, 736

(56) References Cited

U.S. PATENT DOCUMENTS 4,603,278 A * 7/1986 Devir et al. ..... 439/619
4,724,353 A * 2/1988 Devir ..... 439/619
5,120,233 A * 6/1992 Mikola ..... 439/619
5,800,212 A * 9/1998 Hsu ..... 439/619
5,980,329 A * 11/1999 Klein et al. ..... 439/736

* cited by examiner

*Primary Examiner*—Gary Paumen
(74) *Attorney, Agent, or Firm*—Rabin & Berdo, P.C.

(57) ABSTRACT

The invention is an improved bulb cap fixture device supplement which includes a fixture frame attached to the guiding base on a bulb cap. There are a certain number of tenon blocks and tenon grooves on the adjacent surface of the guiding base and the fixture base. The tenon blocks and the tenon grooves are mutually interlocked. The guiding base and the fixture frame can be quickly and conveniently assembled for fixture.

5 Claims, 5 Drawing Sheets

FIXED DEVICE FOR THE BULB SOCKET

BACKGROUND OF THE INVENTION

1) Field of the Invention

The invention is related to a kind of bulb. To be more specific, the invention, attaches a fixture frame on a guiding base of a bulb cap and makes the tenon blocks and the tenon grooves mutually interlock, to improve the bulb cap fixture device supplement for a bulb with a connected guiding wire.

2) Description of the Prior Art

A bulb cap fixture device for a bulb is known in which the lateral sides of a guiding base for a bulb cap are equipped with a tenon element and a concave gear. The fixture frame is equipped with a block element, which is associated with a convex gear on the lateral side. For assembly, the fixture frame is connected with the guiding base on a bulb cap. Through the interlock of the tenon element and the block element, the fixture base fixes firmly to the guiding base to avoid the prior heating compression operation with high frequency wave, and solves the problem caused by high frequency wave heating joint.

During the traditional production process, after the connection of a fixture frame and a guiding base, a high frequency wave heating joint is applied. It produces non-metal material (i.e. industry plastic) with liquid chemical components adhered on the surface of the exposed wire of a guiding base. Thus, a layer of non-electric-conduction material (i.e. plastic membrane) is generated on the surface of an electric wire. As a result, the defectives regarding superficial isolation for an electric wire and dramatic reduction for electric conduction or electric isolation occurs. Also, that high frequency wave heats the fixture base to the joint on the guiding base leads to the defectives of complex production process, high production cost, and environmental pollution due to noxious gas generated by high frequency wave heating. The original invention was not practical or excellent in providing effective solutions for the prior defectives.

Although, for the original invention, the fixture frame connects the guiding base for quick and convenient assembly, the structure is very complex for the concave gears and tenon elements on the lateral sides of a guiding base and the concave gear of a block element on the fixture frame. The relatively complicated design for the production mold leads to a problem of high cost for mold production.

Due to the above problems, the inventor made an improvement to the invention by equipping tenon blocks and tenon grooves at the adjacent joint of the interior of a fixture frame and the exterior of a guiding base for interlocking. As a result, the structure of the fixture frame and the guiding base is greatly simplified and quickly assembled. Low cost for mold production is achieved after conducting constant research. Finally, the invention is developed.

SUMMARY OF THE INVENTION

The primary objective of the invention is to provide a kind of an improved bulb cap fixture device supplement for a bulb, which the adjacent surface of guiding base and fixture frame for the bulb cap equips tenon blocks and tenon grooves for direct fixture. The integral structure of the invention is simplified for quickly and convenient assembly.

The secondary objective of the invention is to provide a kind of an improved bulb cap fixture device supplement for a bulb, which the structure of a guiding base and a fixture frame is simplified and the cost of mold production is reduced.

The following figures illustrate the structure, characteristics, effects, advantage, and embodiments for the invention.

BRIEF DESCRIPTION OF THE TERMS

Figure 1:
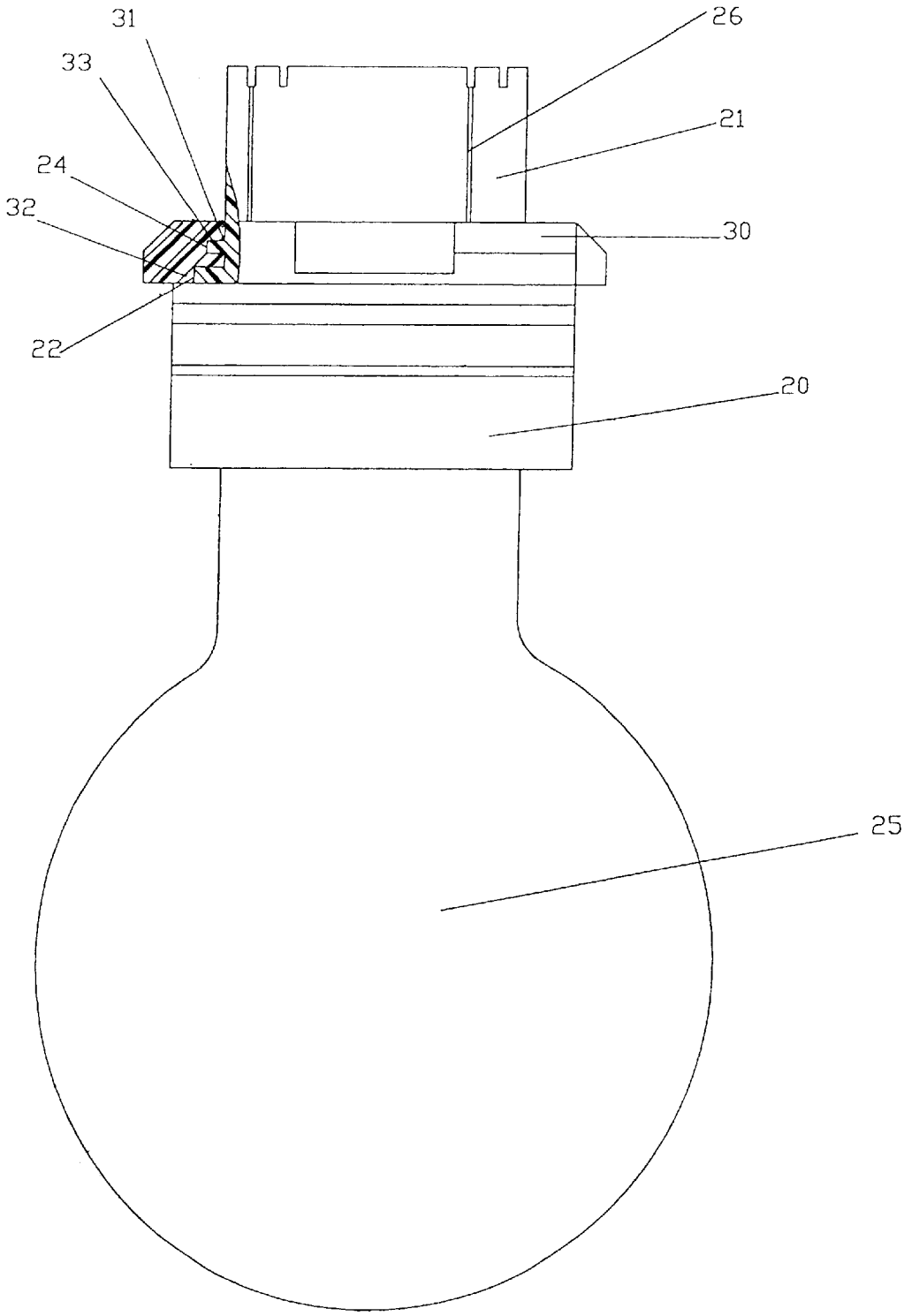
FIG. 1 is a partial sectional drawing of an embodiment of the invention.

| | |
|---|---|
| bulb cap 20 | guiding base 21 |
| step base 22 | segment groove 23 |
| tenon block 24 | glass body 25 |
| connection wire 26 | fixture frame 30 |
| central opening 31 | surrounding groove 32 |
| tenon groove 33 | groove 34 |

DETAILED DESCRIPTION OF THE PREFERRED EMBODIMENT

Figure 2:
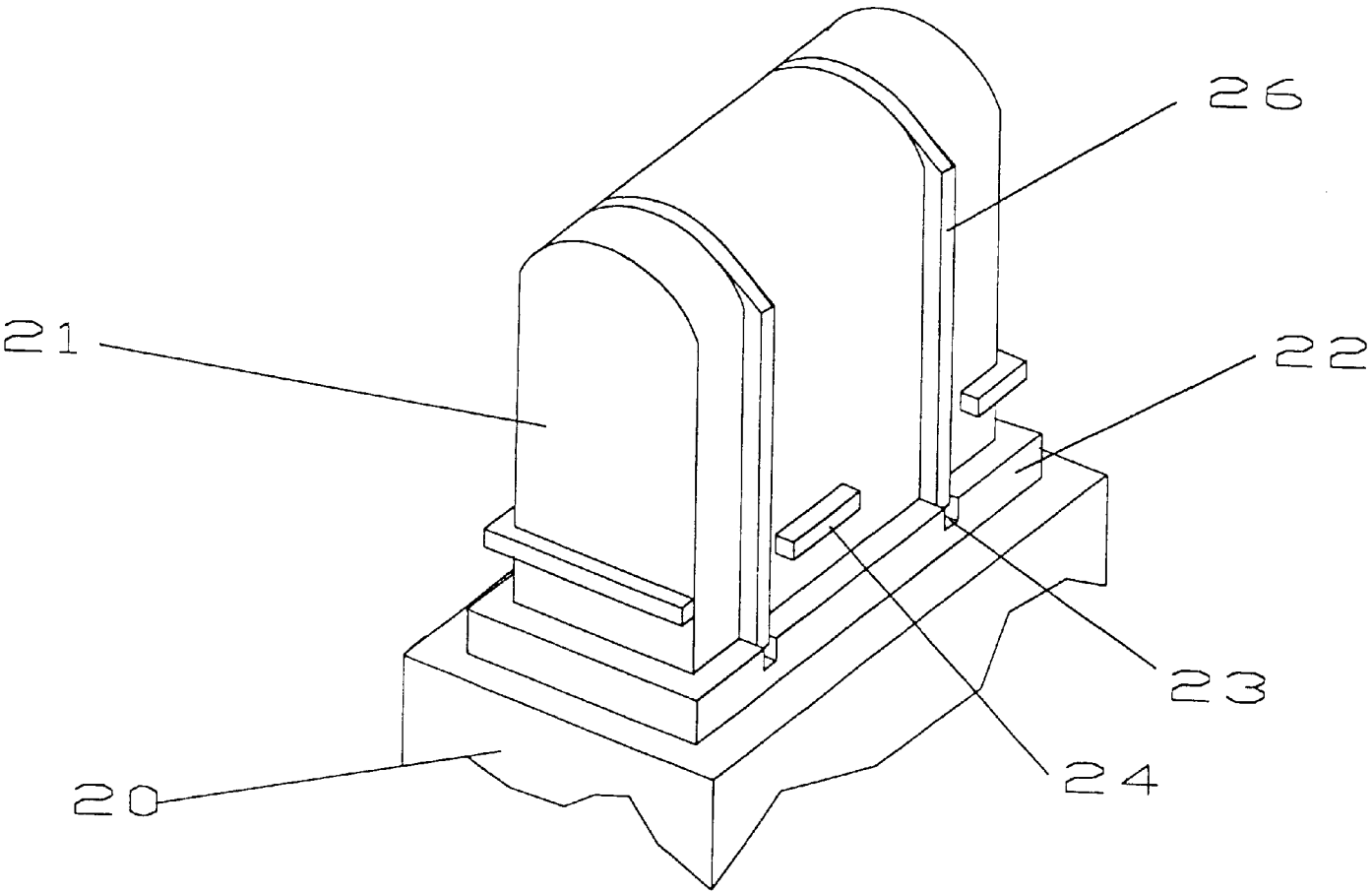
FIG. 2 is a drawing of an embodiment of a bulb cap of the invention.

Please refer to FIGS. 1, and 2. An improved bulb cap fixture device supplement for a bulb, includes a bulb cap 20 and a fixture frame 30.

Figure 4:
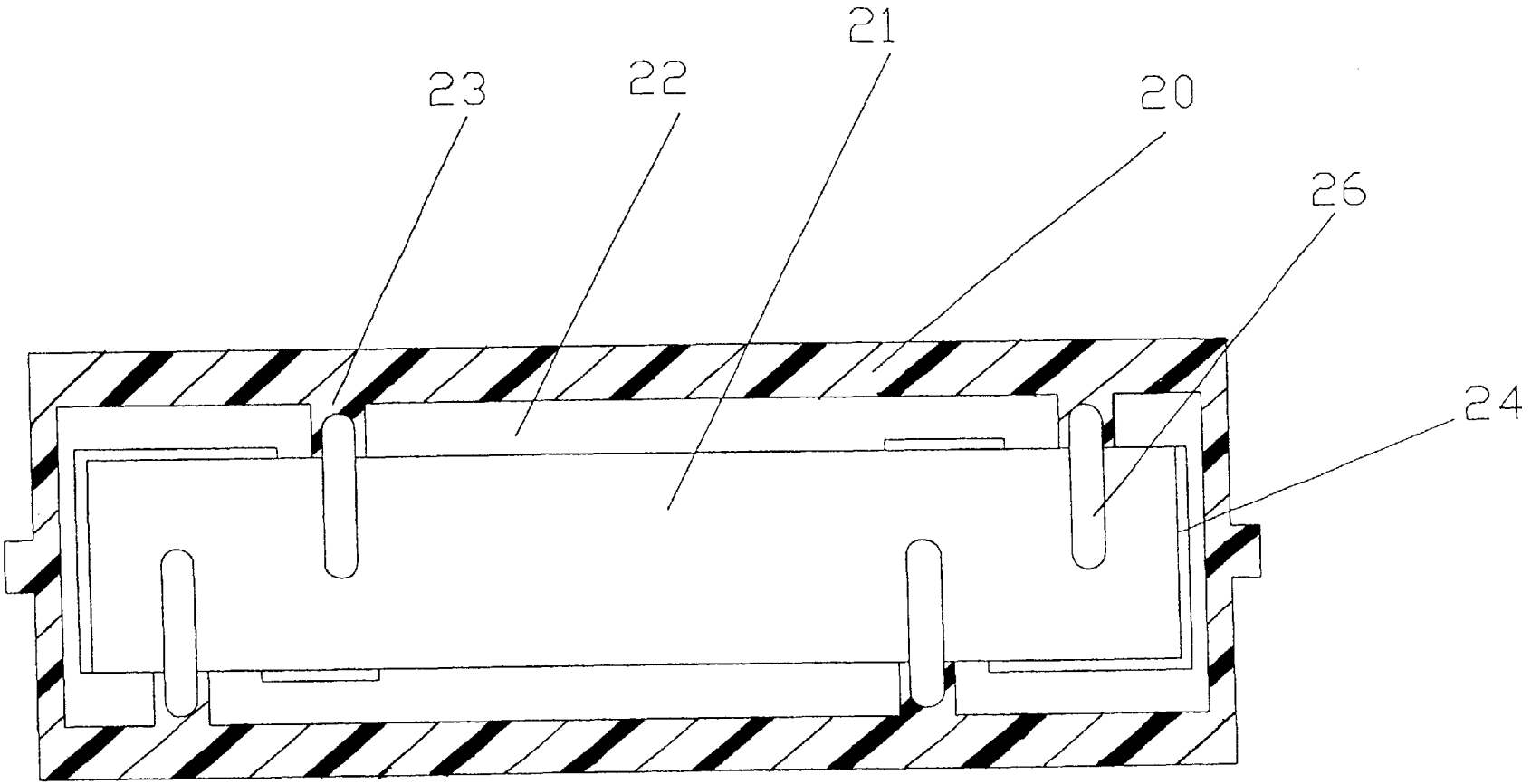
FIG. 4 is a sectional drawing of an embodiment for a guiding base on the bulb cap of the invention.

As shown in FIGS. 1, 2 and 4, the bulb cap 20 is produced by a molded plastic with an extended straight guiding base 21. On the bottom of the guiding base 21, there is a surrounding step base 22, which has four segment grooves 23 arranged in certain spacing. Also, there are four convex tenon blocks 24 located on the surface of the guiding base 21. On the top of step base 22 four electrical connection wires 26 are provided, which are connected with a glass body 25. The glass body 25 is connected to the bulb cap 20. The electrical connection wires 26 penetrate the guiding base 21 and are bent to attach the surface of the guiding base 21 to form positive and negative polar power supply wires.

The fixture frame 30 has a rectangular shape. Please refer FIGS. 1, 3 and 5. The central opening 31 surrounds the guiding base 21. On the inner bottom rim of the central opening 31 opposite to the step base 22, there is a surrounding groove 32. On the inner side of the central opening 31 opposite to the tenon blocks 24, there are four concave tenon grooves 33. The tenon grooves 33 surround the inner central opening 31. There are four grooves on the fixture frame 30 opposite to the segment grooves 23.

Figure 3:
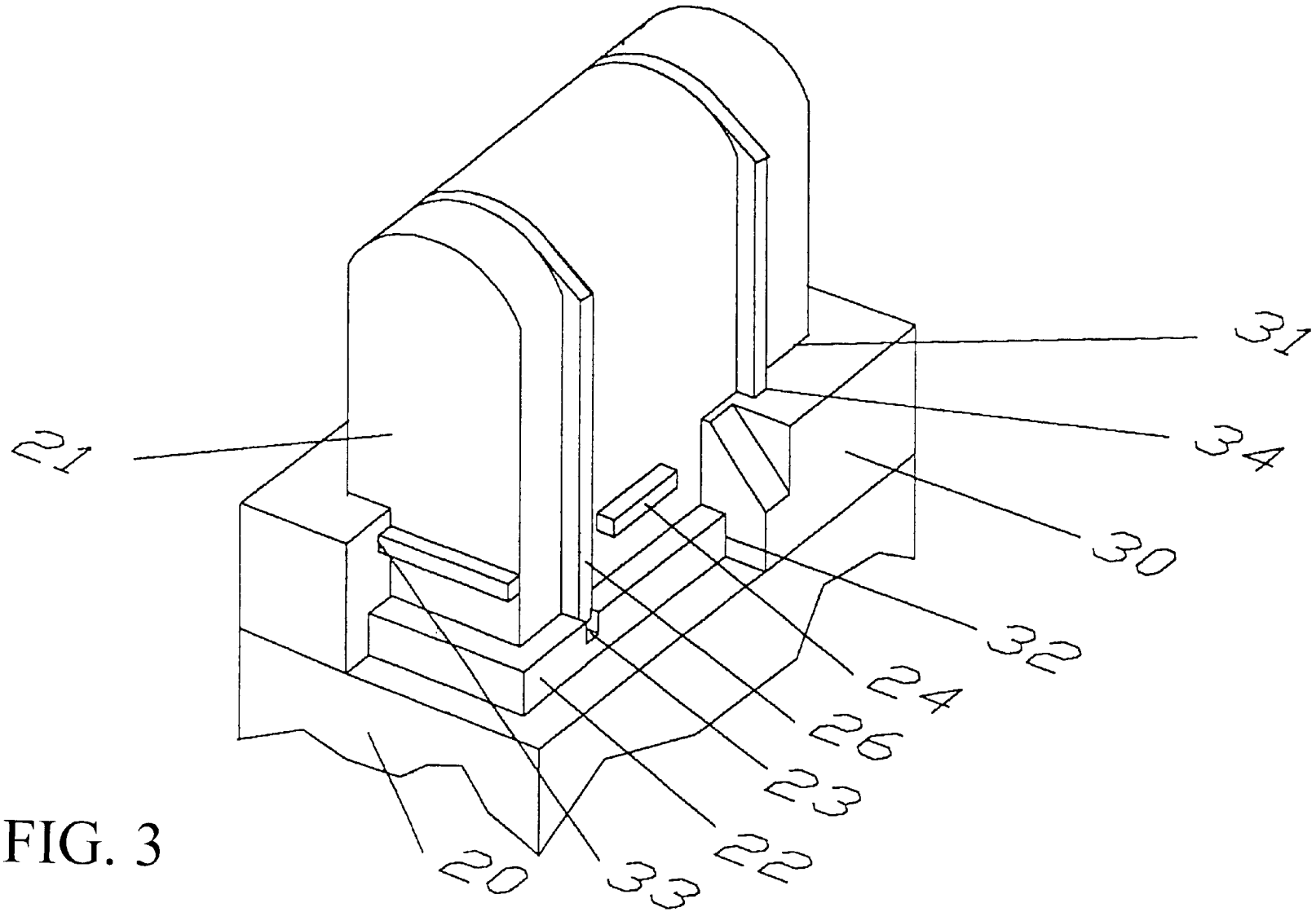
FIG. 3 is a drawing of an embodiment of a bulb cap and a fixture frame of the invention.
Figure 5:
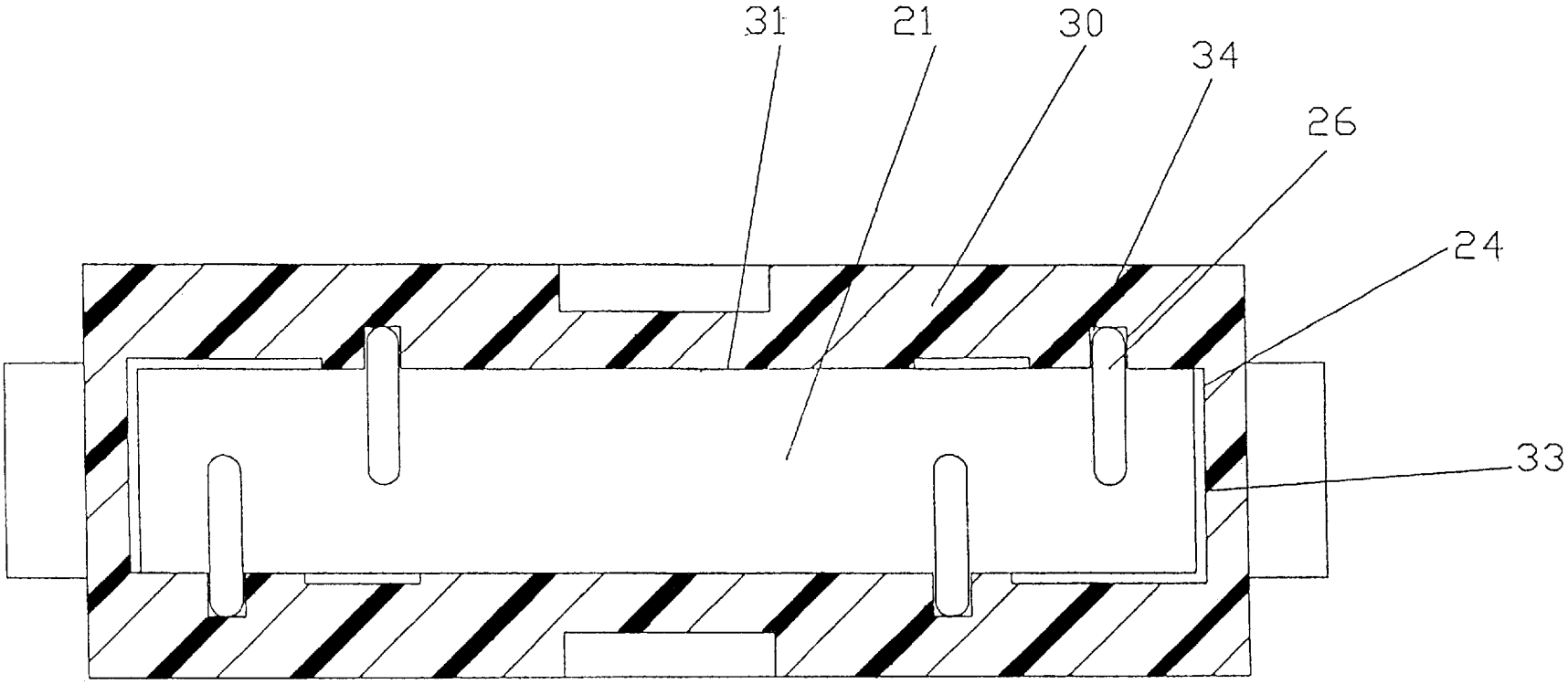
FIG. 5 is the sectional drawing of an embodiment of a joint of the guiding base on the bulb cap and the fixture frame of the invention.

On the basis of the above structure, for the assembly of the invention, please refer FIGS. 1 and 3. The central opening 31 on the fixture frame 30 is fixed to the guiding base 21 on the bulb cap 20. As shown in FIG. 5, the grooves 34 on the inner rim of central opening 31 fix firmly with the connection wires 26 to form a fixed arrangement and attach the connection wire 26 on the surface of the guiding base 21.

The surrounding tenon grooves 33 on the inner sides of the central opening 31 match the surrounding tenon blocks 24 on the guiding base 21 to have identical positions and allocations. Please refer FIGS. 4 and 5. The tenon groove 33 matches the rectangular central opening 31 with symmetrical distribution. Also, the tenon block 24 matches the rectangular guiding base 21 with symmetrical distribution. Thus, the guiding base 21 on the bulb cap 20 can be arbitrarily changed for the left or right direction. The tenon groove 33 matches tenon block 24. Likewise, the fixture frame 30 can be arbitrarily changed for the left or right direction. Tenon groove 33 remains in the position to match tenon block 24. So, both of the fixture frame 30 and the guiding base 21 are not limited by direction and can be adjusted for various directions. The fixture frame 30 fits the guiding base 21. Thus, it is very convenient to connect the central opening 31 on the fixture frame 30 with the guiding base 21 on the bulb cap 20. The fixture frame 30 can be directly pressed to fix the frame to the bottom side of the guiding base 21. Thus, the tenon grooves 33 interlock the tenon blocks 24. The invention allows for quick and convenient assembly, and is very suitable for mass production.

For the invention, the concave tenon grooves 33 interlock the convex tenon blocks 24 to achieve a firm fixture. Please refer FIGS. 1, 2, and 5. The middle section of the central opening 31 on the fixture frame 30 acts as a positioning fixture. In the mean time, the step base 22 joins the surrounding groove 32 and the bottom portion of the fixture frame 30 forms an integral positioning fixture. That is, the central opening 31 of the fixture frame 30 joins the guiding base 21 of the bulb cap 20. Both of the upper and lower sides form a positioning fixture. Thus, the fixture frame 30 joins the guiding base 21 to form a firm positioning fixture.

Also, for the central opening 31 of fixture frame 30, only the tenon grooves 33 are concave. The integral structure is much simpler than the prior art. For the surrounding area of the guiding base 21, only the step base 22 and the tenon block 24 are convex structure. The integral structure is much simpler than the prior art. The integral structure for the fixture frame 30 and the guiding base 21 is greatly simplified. Also, the production mold structure is greatly simplified. Thus, not only may a great amount of mold production cost can be saved but also the maintenance and repair cost for molds can be dramatically reduced.

In summary, the invention is a kind of an improved bulb cap fixture device supplement for a bulb, and is equipped with tenon blocks and tenon grooves on the surrounding face of the guiding base and the fixture frame, respectively, on a bulb cap for direct interlock. The structure of the guiding base and the fixture frame is simplified. The cost for the mold is reduced. Also, the guiding base and fixture frame can be quickly and conveniently assembled. The invention possesses advanced practical usage essence and uniqueness. The above explanation is a substantial embodiment of the invention, which provides greater practical performance than products of the prior art. Furthermore, the present invention meets all new patent application requirements and is lawfully submitted for review and the granting of the commensurate patent rights to thereby encourage the spirit of invention and its rightful protection under the patent law.

What is claimed is:

1. A bulb cap fixture device supplement for a bulb, comprising:

a bulb;

a bulb cap having said bulb fixed on a first side thereof, said bulb cap including a guiding base on a second side thereof and that extends in a direction away from said bulb;

a plurality of electrical conduction wires disposed on said guiding base and being electrically coupled with said bulb; and a fixture frame having a central opening, and a plurality of grooves formed on a wall of said fixture frame that defines the central opening, said guiding base projecting through the central opening so that said wires are pressed and retained in said grooves;

wherein one of said fixture frame and said guiding base includes a plurality of tenon blocks, and another one of said fixture frame and said guiding base includes a plurality of tenon grooves arranged to receive said tenon blocks in an interlocking relationship when said guiding base is received within the central opening.

2. The device recited in claim 1, wherein said tenon blocks are disposed on said guiding base and the tenon grooves are formed in the wall of said fixture frame that defines the central opening.

3. The device recited in claim 2, wherein said tenon blocks are convex and are disposed to surround said guiding base, and the tenon grooves are concave and are disposed to surround the central opening.

4. The device recited in claim 1, wherein said guiding base has a step base surrounding a bottom thereof, and wherein said fixture frame has a surrounding groove formed in the wall that defines the central opening, said step base being received within the surrounding groove in an interlocking relationship when said guiding base is received within the central opening.

5. The device recited in claim 3, wherein said guiding base has a step base surrounding a bottom thereof, and wherein said fixture frame has a surrounding groove formed in the wall that defines the central opening, said step base being received within the surrounding groove in an interlocking relationship when said guiding base is received within the central opening.

* * * * *